US009707436B1

(12) United States Patent
Atwood et al.

(10) Patent No.: US 9,707,436 B1
(45) Date of Patent: Jul. 18, 2017

(54) EXERCISE EQUIPMENT AND CONNECTOR APPARATUSES FOR EXERCISE EQUIPMENT

(71) Applicant: Brunswick Corporation, Lake Forest, IL (US)

(72) Inventors: Lee M. Atwood, St. Francis, MN (US); Matthew Alan Newkirk, Crystal Lake, IL (US)

(73) Assignee: Brunswick Corporation, Lake Forest, IL (US)

( * ) Notice: Subject to any disclaimer, the term of this patent is extended or adjusted under 35 U.S.C. 154(b) by 116 days.

(21) Appl. No.: 14/543,463

(22) Filed: Nov. 17, 2014

(51) Int. Cl.
*A63B 21/00* (2006.01)
*A63B 21/062* (2006.01)

(52) U.S. Cl.
CPC ..... *A63B 21/157* (2013.01); *A63B 21/062* (2013.01)

(58) Field of Classification Search
CPC . A63B 21/4035; A63B 21/06; A63B 21/4043; A63B 23/12; A63B 2023/0411; A63B 2210/50; A63B 21/0442; A63B 21/0628; A63B 21/0728; A63B 21/00061; A63B 21/0557; A63B 21/154; A63B 21/00065; A63B 21/00069; A63B 21/062; A63B 21/063; A63B 21/159; A63B 2225/09; A63B 23/03541; A63B 21/00; A63B 21/157
USPC ..... 482/92–94, 97–98, 57–65
See application file for complete search history.

(56) References Cited

U.S. PATENT DOCUMENTS 585,719 A * 7/1897 Sutton ..... F16D 1/12 297/215.13
2,016,132 A * 10/1935 Bergslien ..... A47C 3/26 248/409
2,280,596 A * 4/1942 McKee ..... B23G 1/16 408/11
3,854,428 A * 12/1974 Fullenkamp ..... A47B 9/00 108/136
4,772,069 A * 9/1988 Szymski ..... B62J 1/08 297/214
4,807,856 A * 2/1989 Teckenbrock ..... B62K 19/36 188/67
5,007,655 A * 4/1991 Hanna ..... A61G 5/023 280/245

(Continued)

*Primary Examiner* — Andrew S Lo
(74) *Attorney, Agent, or Firm* — Andrus Intellectual Property Law, LLP

(57) ABSTRACT

A connector apparatus connects a first component of an exercise machine to a second component of the exercise machine. The connector apparatus comprises a rack coupled to the first component; a pinion gear coupled to the second component, the pinion gear being configured to mate with the rack such that the pinion gear can roll along the rack; a one-way bearing that allows the pinion gear to roll along the rack in a first direction and prevents the pinion gear from rolling along the rack in an opposite, second direction; and a handle that is coupled to the one-way bearing. The handle is configured to move back and forth between a first position wherein the pinion gear is mated with the rack and allowed by the one-way bearing to roll along the rack in the first direction and prevented by the one-way bearing from rolling along the rack in the second direction; and a second position wherein the pinion gear is separated from the rack and is freely movable in the first and second directions.

18 Claims, 9 Drawing Sheets

(56) References Cited

U.S. PATENT DOCUMENTS 5,153,953 A * 10/1992 Sumrall ..... A61G 7/1019 5/81.1 R
5,234,187 A * 8/1993 Teppo ..... A47B 9/06 248/161
5,352,167 A * 10/1994 Ulicny ..... A63B 22/0023 482/54
5,779,249 A * 7/1998 Lin ..... B62K 19/36 280/287
5,795,026 A * 8/1998 Dral ..... A47C 1/03 297/411.2
5,870,928 A * 2/1999 Genter ..... F16H 55/18 74/409
5,992,253 A * 11/1999 Petersen ..... A63B 21/15 482/137
6,230,867 B1 * 5/2001 Schwarzbich ..... B60N 2/167 192/15
6,354,557 B1 * 3/2002 Walsh ..... B62K 19/36 248/408
6,543,850 B1 * 4/2003 Becker ..... B60N 2/0232 297/362
6,857,378 B2 * 2/2005 Franze ..... A47B 9/06 108/146
6,913,560 B2 7/2005 Ryan et al.
6,932,745 B1 * 8/2005 Ellis ..... A63B 22/0023 482/52
7,364,535 B1 4/2008 Rosenow et al.
7,708,251 B2 * 5/2010 Watt ..... A63B 22/0046 248/407
7,874,615 B2 1/2011 Huyck et al.
8,021,278 B2 * 9/2011 Huyck ..... A63B 22/0605 297/215.13
8,128,306 B2 * 3/2012 Gorza ..... B62J 1/08 248/354.7
8,480,170 B2 * 7/2013 Lu et al. ..... B62J 1/08 297/195.1
8,496,098 B1 * 7/2013 Napau ..... B60N 2/165 192/15
8,496,297 B2 7/2013 Huyck et al.
8,960,104 B2 * 2/2015 Copeland ..... A47B 3/00 108/117
2002/0140266 A1 * 10/2002 Broekhuis ..... A47C 3/265 297/353
2004/0204298 A1 * 10/2004 Chen ..... A63B 22/0605 482/57
2006/0166792 A1 * 7/2006 Kuo ..... A63B 22/0605 482/57
2007/0216210 A1 * 9/2007 Kim ..... B60N 2/165 297/344.15
2011/0278893 A1 * 11/2011 Costaglia ..... A47C 3/20 297/344.15
2012/0010053 A1 * 1/2012 Bayerlein ..... A63B 21/0053 482/54
2016/0033030 A1 * 2/2016 Palfai ..... F16H 57/12 74/409

* cited by examiner

EXERCISE EQUIPMENT AND CONNECTOR APPARATUSES FOR EXERCISE EQUIPMENT

FIELD

The present disclosure relates to exercise equipment.

BACKGROUND

The following U.S. Patents are incorporated herein by reference.

U.S. Pat. No. 8,496,297 discloses several mechanisms for permitting a user to adjust the seat on a stationary exercise bicycle. The described mechanisms can be used to adjust the height of the seat or the fore and aft positioning of the seat on an upright type bicycle. Each of the described mechanisms can be configured to provide users with an optimum seat position and with a convenient latch mechanism to adjust the position of the seat U.S. Pat. No. 7,874,615 discloses several mechanisms for permitting a user to adjust the seat on a stationary exercise bicycle. The described mechanisms can be used to adjust the height of the seat or the fore and aft positioning of the seat on an upright type bicycle. Each of the described mechanisms can be configured to provide users with an optimum seat position and with a convenient latch mechanism to adjust the position of the seat. Also described is a seat mechanism for use with a recumbent type stationary exercise bicycle where the seat can be adjusted along the longitudinal length of the bicycle U.S. Pat. No. 7,364,535 discloses an exercise apparatus having a biased tolerance-compensating engagement system between a seat-supporting carriage and a tubular support column to provide zero clearance between adjustment rollers and the support column, to minimize wobble during user adjustment.

U.S. Pat. No. 6,913,560 discloses a stationary exercise bicycle having a frame, a resistance member, a drive assembly, a right pedal, a left pedal, a seat and an adjustable seat mechanism utilizing a rack. Assembly and disassembly of a three piece crank arm assembly is accomplished without requiring the assembling and disassembling of the entire drive assembly. The stationary exercise bicycle also provides a variety of users with an optimum seat position and with a convenient latch mechanism.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain examples disclosed herein, a connector apparatus is configured to connect a first component of an exercise machine to a second component of the exercise machine. The connector apparatus can comprise a rack coupled to the first component; a pinion gear coupled to the second component, the pinion gear being configured to mate with the rack such that the pinion gear can roll along the rack; a one-way bearing that allows the pinion gear to roll along the rack in a first direction and prevents the pinion gear from rolling along the rack in an opposite, second direction; and a handle that is coupled to the one-way bearing. The handle is configured to move back and forth between a first position wherein the pinion gear is mated with the rack and allowed by the one-way bearing to roll along the rack in the first direction and prevented by the one-way bearing from rolling along the rack in the second direction, and a second position wherein the pinion gear is separated from the rack and is freely movable in the first and second directions.

BRIEF DESCRIPTION OF THE DRAWINGS

Examples of exercise equipment are described with reference to the following drawing figures. The same numbers are used throughout the drawing figures to reference like features and components.

DETAILED DESCRIPTION OF THE DRAWINGS

Figure 1:
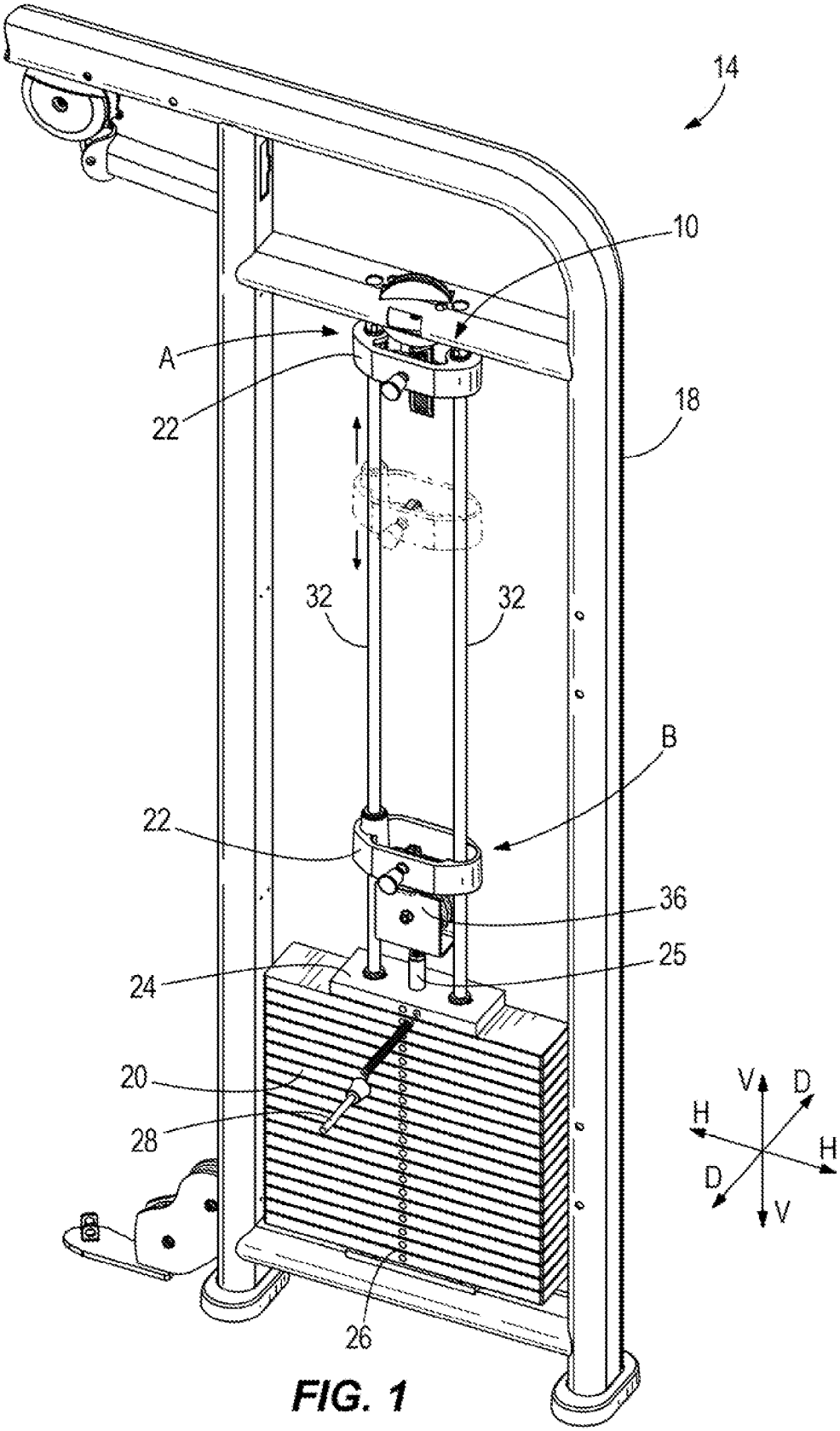
FIG. 1 is a perspective view of an exercise machine having one example of a connector apparatus according to the present disclosure.

In the present description, certain terms have been used for brevity, clarity and understanding. No unnecessary limitations are to be inferred therefrom beyond the requirement of the prior art because such terms are used for descriptive purposes only and are intended to be broadly construed. The different apparatuses described herein may be used alone or in combination with other apparatuses.

FIGS. 1-4 depict portions of an exercise machine 14 that extends in a vertical direction V, a depth direction D that is perpendicular to the vertical direction V, and a horizontal direction H that is perpendicular to the depth direction D and perpendicular to the vertical direction V. In this example, the exercise machine 14 is a stationary weight lifting apparatus that includes a supporting frame 18, a vertical stack of primary weights 20 that are supported on the frame 18 via guide bars 32, and a plurality of incremental secondary weights 22 that are also supported on the frame 18 via the guide bars 32. In use, the operator can selectively add or remove secondary weights 22 from the vertical stack of primary weights 20 before exercise commences. In certain examples, each secondary weight 22 has a mass that is less than the mass of each primary weight 20, thus allowing incremental control of the amount of weight being lifted. However as will become evident from the following discussion, the type of exercise machine can vary and the concepts of the present disclosure are applicable to completely different types of exercise machines. As such, the examples provided herein are not intended to be limiting.

As shown in FIGS. 1-4, each primary weight 20 is supported on the frame 18 by the pair of guide bars 32 such that it can slide up and down along the guide bars 32 in the vertical direction V. A head plate 24 is disposed on top of the stack of primary weights 20 and is also supported on the frame 18 by the pair of guide bars 32 such that it can slide up and down along the guide bars 32 in the vertical direction V. The head plate 24 carries a bayonet 25 that extends vertically downwardly from the head plate 24 through a series of vertically extending holes (not shown) in the primary weights 20. The bayonet 25 has a series of horizontally extending holes (not shown) that are aligned with similar horizontally extending holes 26 in the primary weights 20 when the exercise machine 14 is at rest. Prior to exercising, an operator can insert a selector pin 28 into one of the holes 26 and through a corresponding hole in the bayonet 25 to thereby couple the bayonet 25 and head plate 24 to that particular primary weight 20. A cable (not shown) is connected to the head plate 24 and extends from the frame 18 to a user-operable member (not shown), which can be a weight bar, a pedal, or any other like exercise member. When the operator operates the exercise member (e.g., by pushing or pulling the member depending on the particular configuration of the machine, which can vary), a tension force on the cable lifts the head plate 24, bayonet 25, the selected primary weight 20, and all the primary weights 20 located vertically above the selected primary weight 20 along the guide bars 32. Releasing the tension on the cable allows the head plate 24, bayonet 25, selected primary weight 20 and the primary weights located vertically above the selected primary weight 20 to move back down along the guide bars 32 to the position shown in FIG. 1.

The secondary weights 22 are located above the stack of primary weights 20 and are also mounted to and configured to slide along the guide bars 32. The secondary weights 22 are movable between a stored position shown at arrow A in FIG. 1 and a use position shown at arrow B in FIG. 1. A connector apparatus 10 is uniquely configured to releasably connect the secondary weight 22 to the frame 18 when the secondary weight 22 is in the stored position. As mentioned herein above, prior to operating the cable, the operator can add or subtract secondary weights 22 to or from the stack of primary weight 20 to thereby adjust the amount of weight connected to the cable. To add weight, the operator manually operates the connector apparatus 10 to disengage a secondary weight 22 from the top of the guide bars 32 and then manually slides the secondary weight 22 downwardly along the guide bars 32 and onto a support member 36, which is located on the head plate 24. Thereafter, lifting of the primary weights 20 also requires lifting of the secondary weights 22 located on the support member 36. To remove weight, the operator can slide the noted secondary weights 22 vertically upwardly along the guide bars 32 until the connector apparatus 10 engages with the frame 18 in the stored position. Thus this arrangement allows for incremental control of the amount of weight connected to the cable.

Figure 2:
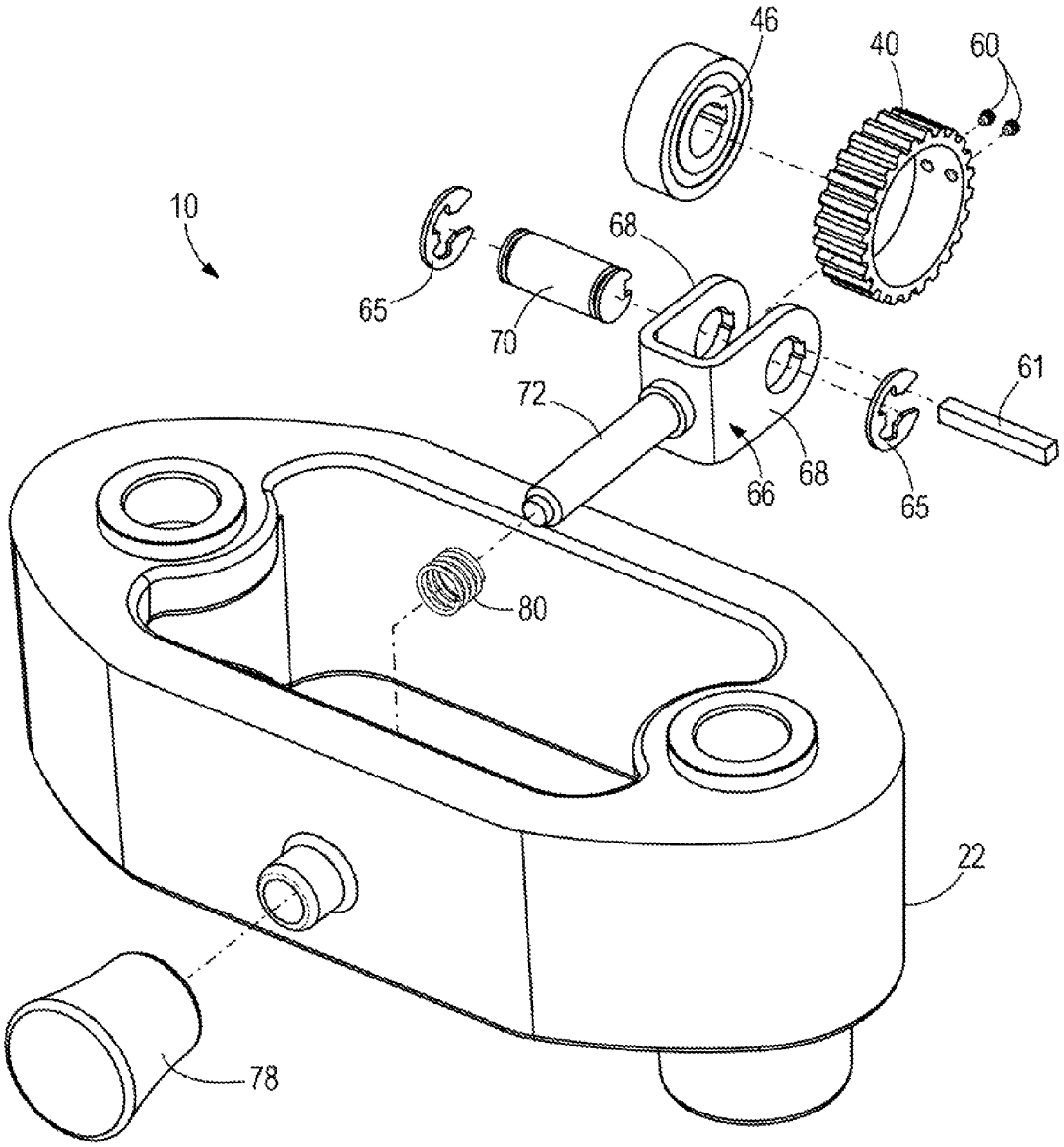
FIG. 2 is an exploded view of a portion of the connector apparatus of FIG. 1, which connects a first component of the exercise machine to a second component of the exercise machine.
Figure 3:
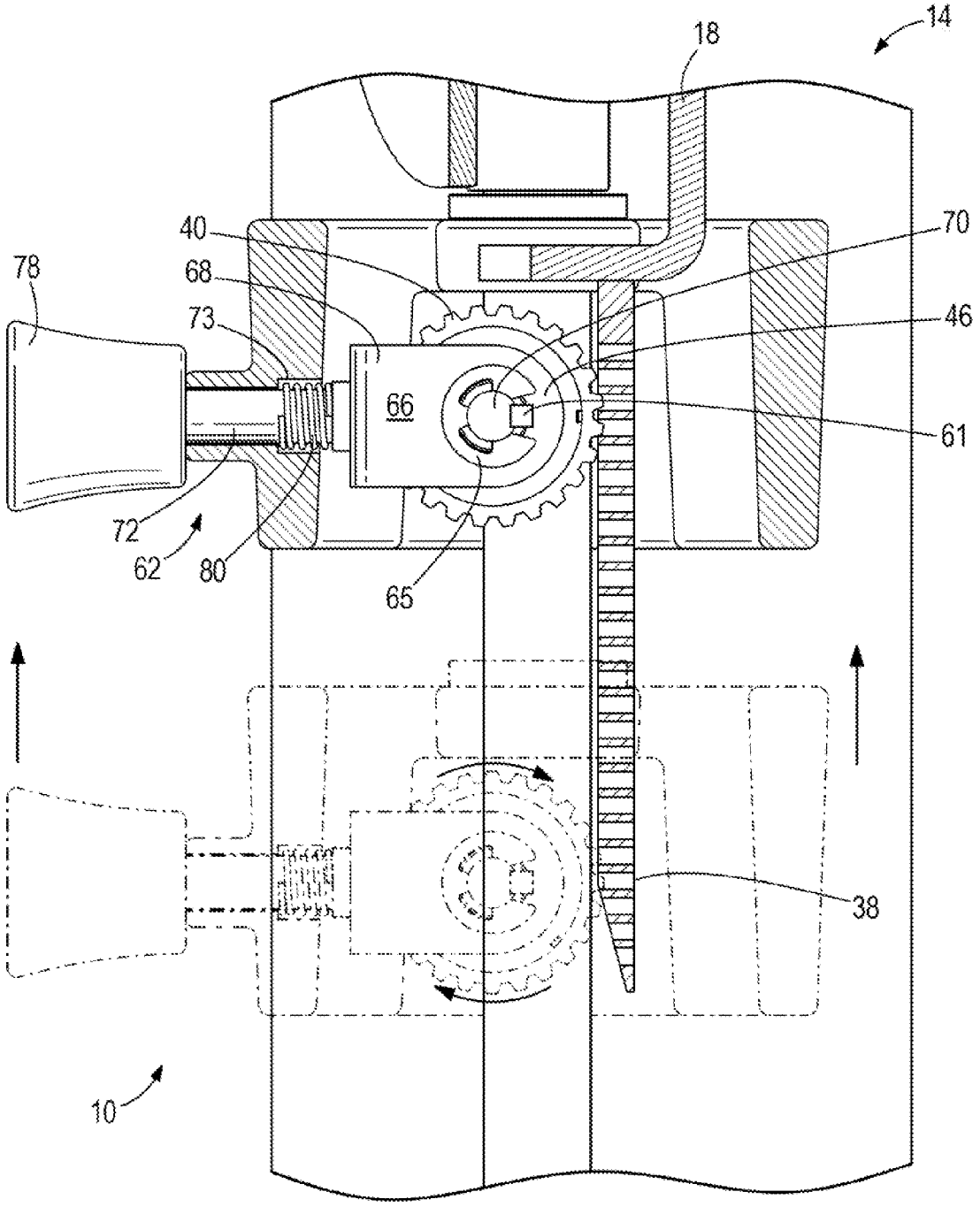
FIG. 3 depicts movement of the first component of the exercise machine of FIG. 1 in a first direction with respect to a second component of the exercise machine.
Figure 4:
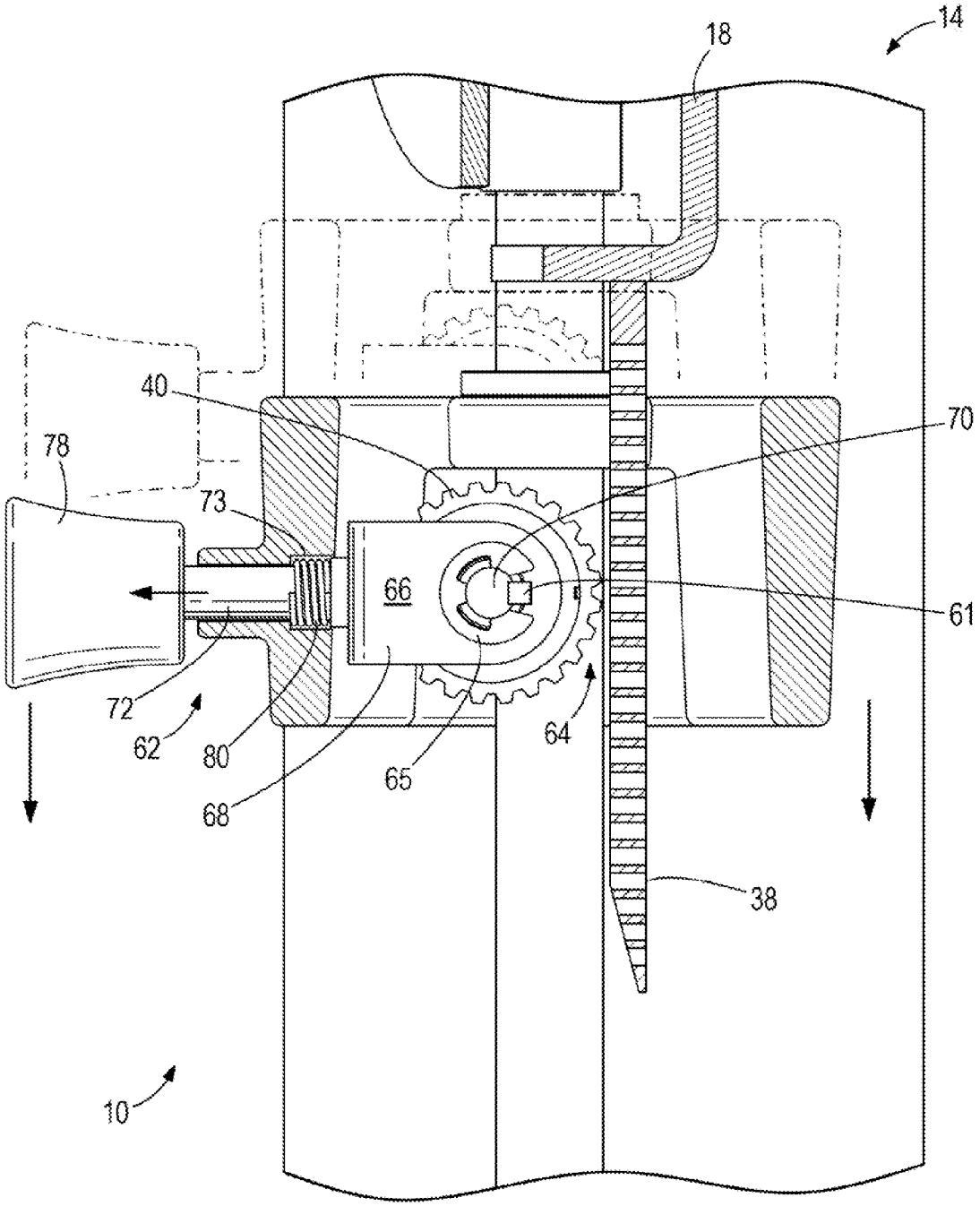
FIG. 4 depicts movement of the first component of the exercise machine of FIG. 1 in an opposite, second direction with respect to the second component of the exercise machine.
Figure 5:
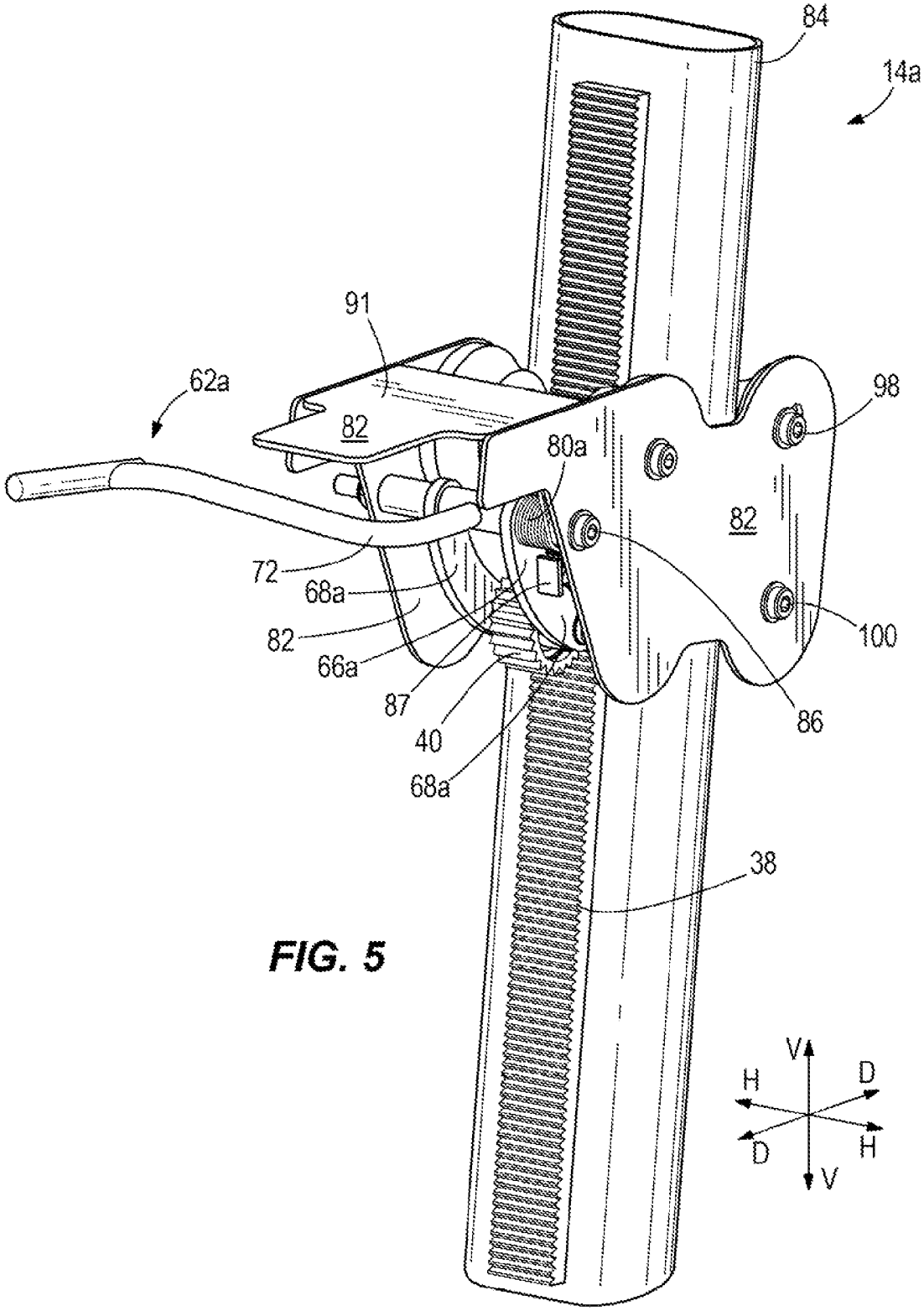
FIG. 5 is a perspective view of another example of an exercise machine having another example of a connector apparatus according to the present disclosure.
Figure 6:
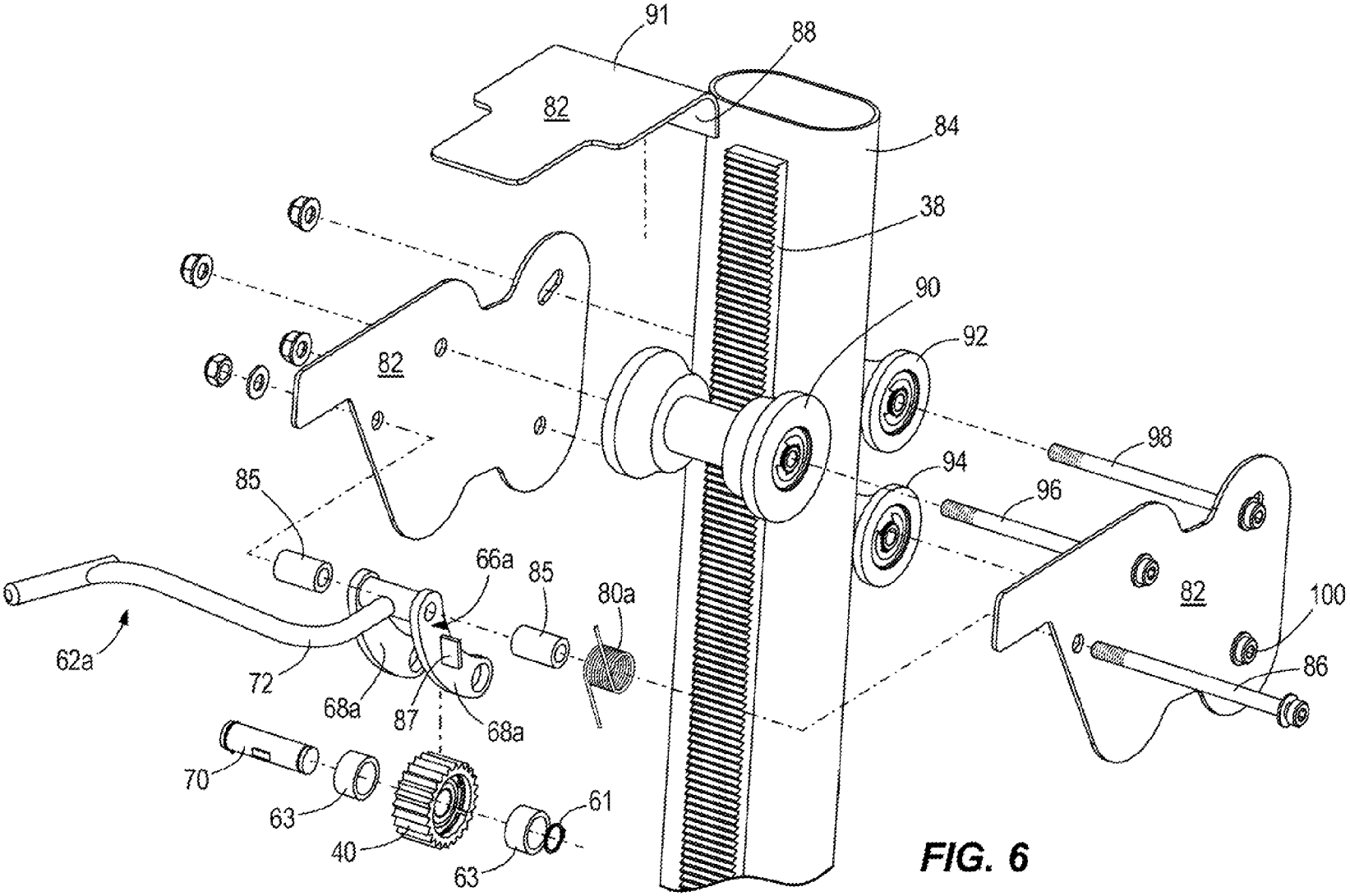
FIG. 6 is an exploded view showing portions of the connector apparatus of FIG. 5, which connects a first component of the exercise machine to a second component of the exercise machine.
Figure 10:
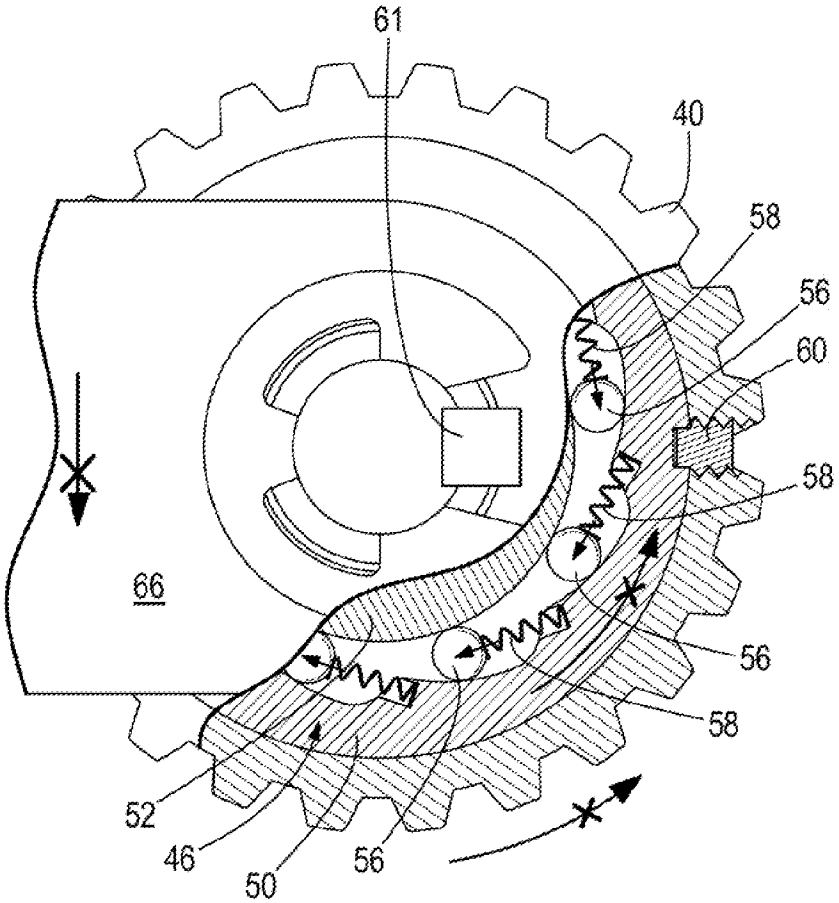
FIGS. 9 and 10 depict an exemplary one-way bearing for the connector apparatus.
Figure 9:
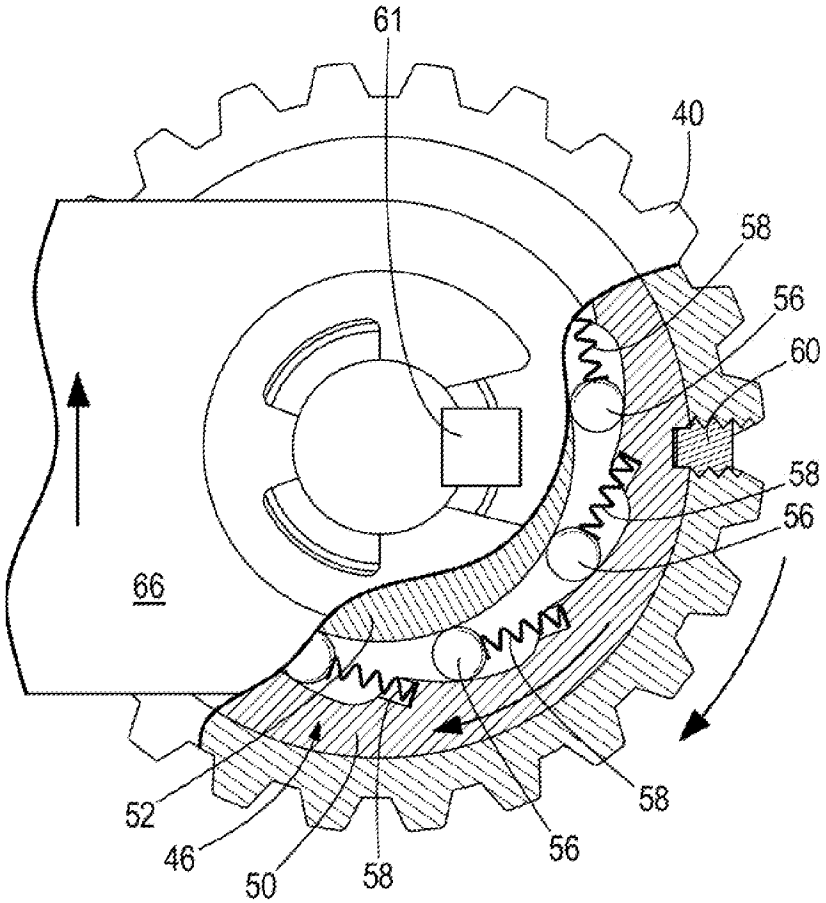

Referring to FIGS. 2-4, the connector apparatus 10 includes a rack 38 that is attached to the frame 18 a location near the top of the guide bars 32, and a pinion gear 40 on each of the secondary weights 22. Each pinion gear 40 is configured to mate with the rack 38 such that the pinion gear 40 can freely roll along the rack 38 in a clockwise direction, as shown in FIG. 3. The pinion gear 40 includes a one-way bearing 46, which is shown in FIGS. 9 and 10. The one-way bearing 46 allows the pinion gear 40 to roll along the rack 38 in the clockwise direction so that the secondary weight 22 is movable in the vertically upward direction. The one-way bearing 46 prevents the pinion gear 40 from rolling along the rack 38 in the counterclockwise direction, so that the secondary weight 22 is prevented from moving in the vertically downward direction when the pinion gear 40 is engaged with the rack 38.

Referring to FIGS. 9 and 10, the one-way bearing 46 includes a cylindrical outer race 50 and an inner race 52. The outer race 50 has a plurality of ramps 54. The pinion gear 40 is keyed to the outer race 50 by set screws 60 such that the pinion gear 40 and outer race 50 rotate with each other. A plurality of rollers 56 is trapped between the inner and outer races 50, 52. Each roller 56 is spring-loaded by springs 58. During clockwise rotation of the pinion gear 40 along the rack 38, the rollers 56 freely rotate because the springs 58 force the rollers 56 against the inner race 52 and the ramps 54 of the outer race 50. Refer to FIG. 9. However, opposite rotation of the pinion gear 40 causes the rollers 56 to lock against the outer race 50 and ramps 54 of the inner race 52, thus preventing movement of the pinion gear 40 downwardly with respect to the rack 38. Refer to FIG. 10. One-way bearings of this type are available from Renold at www.renold.com.

Referring to FIGS. 2-4, a handle 62 is coupled to the one-way bearing 46. In this example, the handle 62 can be manually moved back and forth between a first position shown in FIG. 3, wherein the pinion gear 40 is mated with the rack 38 and is allowed by the one-way bearing 46 to roll along the rack 38 in the upward direction and prevented by the one-way bearing 46 from rolling along the rack 38 in the downward direction, and a second position shown in FIG. 4, wherein the pinion gear 40 is separated from the rack 38, as shown at arrow 64, and thus is freely movable in the upward and downward directions.

In this example, a bracket 66 connects the handle 62 to the pinion gear 40. The bracket 66 includes a pair of ears 68 and a stationary shaft 70 that is supported by pair of ears 68. A pair of clips 65 retain the shaft 70 with respect to the bracket 66. The stationary shaft 70 extends through the pinion gear 40 and is keyed to the inner race 52 of the one-way bearing 46 by a key 61, thus preventing rotation of the inner race 52 of the one-way bearing 46. The pinion gear 40 thus rotates about the stationary shaft 70, as permitted by the one-way bearing 46, as described herein above. An axial shaft 72 has a first end attached to the bracket 66 and an opposite, second end attached to a knob 78. A compression spring 80 is disposed about the shaft 72 between the bracket 66 and a recess 73 in the secondary weight 22. The spring 80 biases the knob 78 into the position shown in FIG. 3. The spring 80 axially biases the pinion gear 40 into the noted first position. Manually pulling on the knob 78, against the bias of spring 80, as shown in FIG. 4, compresses the spring 80 and separates the pinion gear 40 from the rack 38 (at arrow 64) and thus allows the pinion gear 40 to be freely moved in the upward and downward directions.

FIGS. 5-8 depict another example of an exercise machine **14*a* having a connector apparatus 10*a* in accordance with the present disclosure. Like features are numbered accordingly, with reference to the description here above regarding FIGS. 1-4. In this example the noted first component is a supporting bracket 82 for supporting a seat for a weight lifting apparatus or other stationary exercise apparatus, for example a stationary bicycle and/or the like. The noted second component is a seat post 84** for the apparatus.

In FIGS. 5-8, the handle 62*a* is pivotable about a bolt 86 with respect to the seat post 84 and rack 38. The pinion gear 40 is spaced from the ears 68*a* of the bracket 66*a* by spacers 63. The ears 68*a* of the bracket 66*a* are curved and the spring 80*a* is a torsion spring that is disposed along one of a pair of spacers 85 that are supported by the bolt 86. The spacers 85 space the ears 68*a* of the bracket 66*a* from the supporting bracket 82. One of the ears 68*a* has a tab 87 for engaging with one end of the torsion spring 80*a*. The other end of the torsion spring 80*a* engages with an end portion 88 of a top plate 91 of supporting bracket 82. A plurality of rollers, including a forward roller 90 and a pair of rearward rollers 92, 94 are rollably supported by the supporting bracket 82 via bolts 96, 98, 100. The rollers 90, 92, 94 are configured to roll along the seat post 84.

Figure 7:
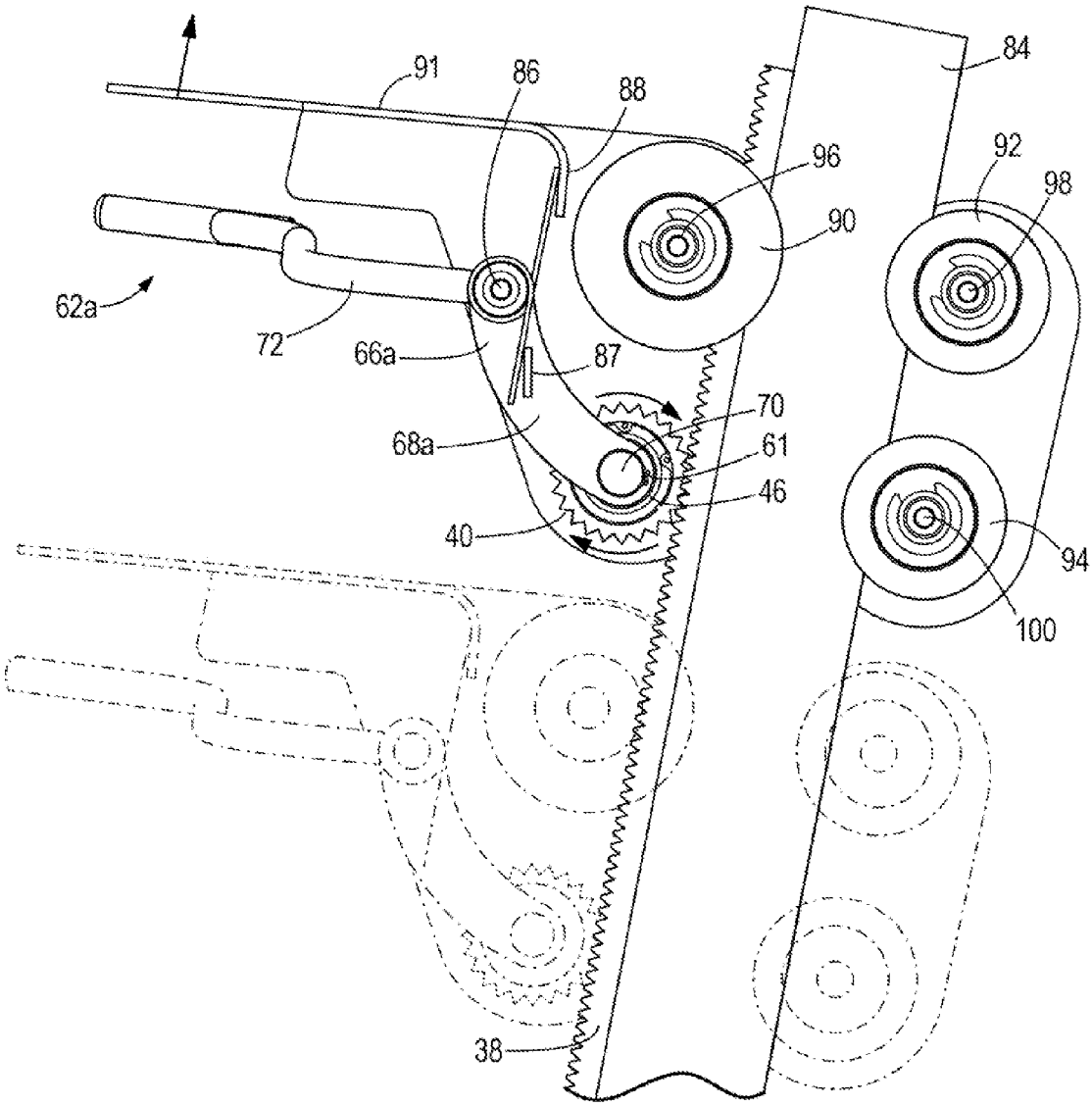
FIG. 7 depicts movement of the first component of the exercise machine of FIG. 5 in a first direction with respect to a second component of the exercise machine.
Figure 8:
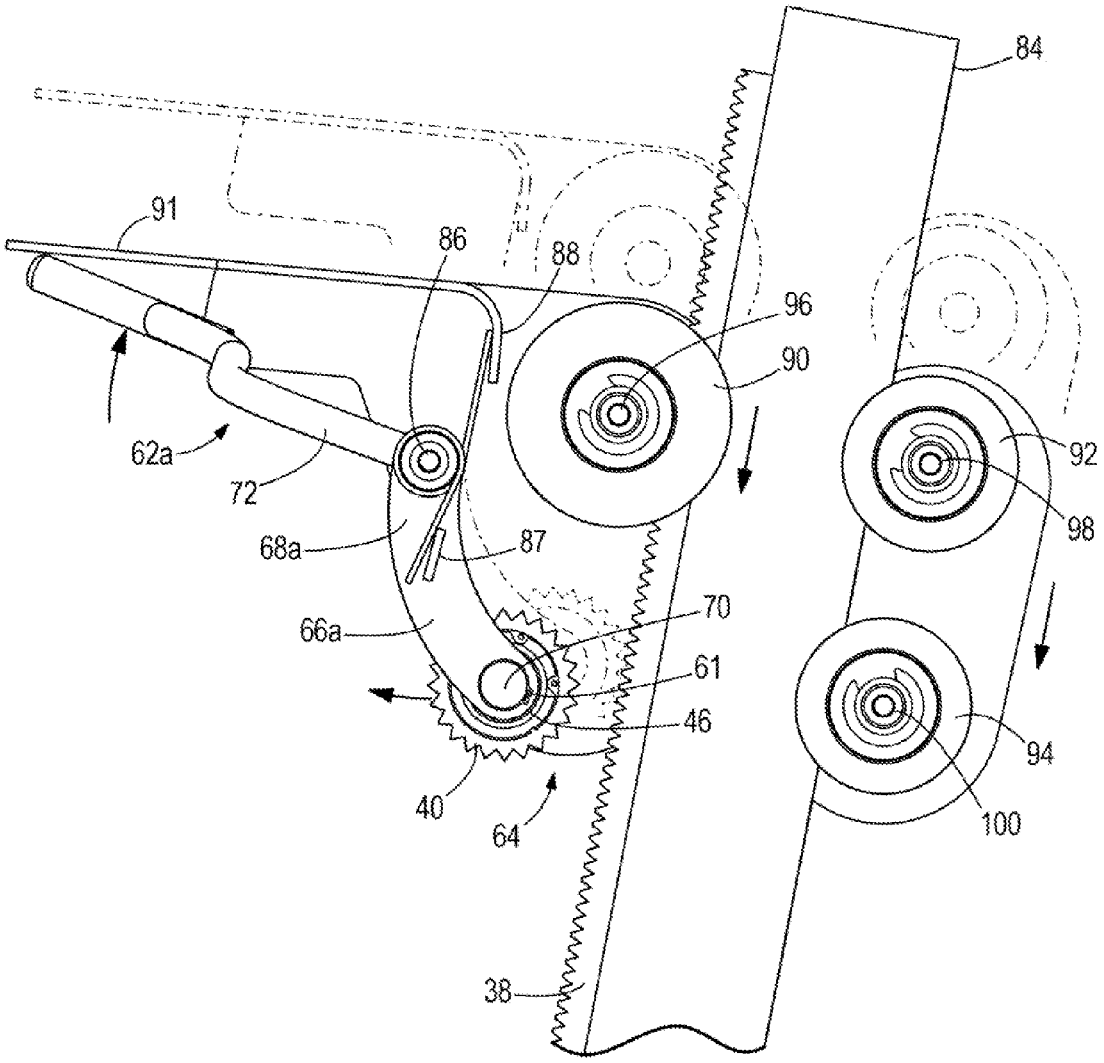
FIG. 8 depicts motion of the first component of the exercise machine of FIG. 5 in an opposite, second direction with respect to the second component of the exercise machine.

Pivoting of the handle 62*a* about the bolt 86 in a clockwise direction, as shown in FIG. 8, moves the pinion gear 40 away from the rack 38 such that a separation, shown at arrow 64, is formed between the pinion gear 40 and the rack 38. This allows free movement of the connector apparatus 10 in the direction of arrows 44, 48, as guided by rollers 90, 92, 94. The torsion spring 80*a* naturally biases the handle 62*a*, bracket 66*a* and pinion gear 40*a* back counterclockwise, as viewed in FIG. 8, such that the pinion gear 40 engages with the rack 38, as shown in FIG. 7. In this position, the handle 62*a* is freely movable along the post 84 in the upward direction and prevented by the one-way bearing 46 from rolling along the rack 38 in the downward direction, as described herein above.

The present disclosure thus provides a connector apparatus 10 for exercise machines. The connector apparatus 10 connects a first component of the exercise machine 14 such as the frame 18 or post 84 to a second component of the exercise machine 14 such as the secondary weight 22 or bracket 82. A rack 38 is coupled to the first component. A pinion gear 40 is coupled to the second component. The pinion gear 40 is configured to mate with the rack 38 such that the pinion gear 40 can roll along the rack 38. A one-way bearing 46 allows the pinion gear 40 to roll along the rack 38 in a first direction (FIGS. 3 and 7) and prevents the pinion gear 40 from rolling along the rack 38 in an opposite, second direction (FIGS. 4 and 8). A handle 62 is coupled to the one-way bearing 46 and is configured to move back and forth between a first position (FIGS. 3 and 7) wherein the pinion gear 40 is mated with the rack 38 and allowed by the one-way bearing 46 to roll along the rack 38 in the first direction and prevented by the one-way bearing 46 from rolling along the rack 38 in the second direction, and a second position (FIGS. 4 and 8) wherein the pinion gear 40 is separated from the rack 38 and is freely movable in the first and second directions.

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

What is claimed is:

1. A connector apparatus that connects a first component of an exercise machine to a second component of the exercise machine, the connector apparatus comprising:

a rack coupled to the first component;

a pinion gear coupled to the second component, wherein the pinion gear is configured to mate with the rack such that the pinion gear can roll along the rack;

a one-way bearing that allows the pinion gear to roll along the rack in a first direction and prevents the pinion gear from rolling along the rack in an opposite, second direction; and a handle that is coupled to the one-way bearing, wherein the handle is configured to move back and forth between i. a first position wherein the pinion gear is mated with the rack and allowed by the one-way bearing to roll along the rack in the first direction and prevented by the one-way bearing from rolling along the rack in the second direction; and ii. a second position wherein the pinion gear is separated from the rack and is freely movable in the first and second directions.

2. The apparatus according to claim 1, comprising a spring that biases the handle into the first position.

3. The apparatus according to claim 2, comprising a bracket that supports the pinion gear.

4. The apparatus according to claim 3, wherein the bracket comprises a pair of ears, and further comprising a stationary shaft that is supported by the pair of ears, wherein the pinion gear rotates about the stationary shaft.

5. The apparatus according to claim 4, wherein the stationary shaft is keyed to the bracket.

6. The apparatus according to claim 4, wherein the handle comprises a knob and an elongated shaft that has a first end attached to the bracket and an opposite second end attached to the knob.

7. The apparatus according to claim 6, wherein the spring is disposed on the shaft, wherein the spring axially biases the pinion gear into the first position, and wherein pulling on the handle against the spring moves the pinion gear into the second position.

8. The apparatus according to claim 2, wherein the handle is pivotable with respect to the second component.

9. The apparatus according to claim 8, wherein the handle is connected to a pivot shaft coupled to the second component and wherein the spring is a torsion spring disposed on the pivot shaft.

10. The apparatus according to claim 9, wherein pivoting the handle against the spring moves the pinion gear into the second position.

11. The apparatus according to claim 1, wherein the first component comprises a weight and the second component comprises a weight rack.

12. An exercise machine, comprising:

a first component;

a second component;

connector apparatus comprising a rack coupled to the first component, a pinion gear coupled to the second component, wherein the pinion gear is configured to mate with the rack such that the pinion gear can roll along the rack, a one-way bearing that allows the pinion gear to roll along the rack in a first direction and prevents the pinion gear from rolling along the rack in an opposite, second direction, and a handle that is coupled to the one-way bearing, wherein the handle is configured to move back and forth between i. a first position wherein the pinion gear is mated with the rack and allowed by the one-way bearing to roll along the rack in the first direction and prevented by the one-way bearing from rolling along the rack in the second direction; and ii. a second position wherein the pinion gear is separated from the rack and is freely movable in the first and second directions.

13. The machine according to claim 12, comprising a spring that biases the handle into the first position.

14. The machine according to claim 13, comprising a bracket that supports the pinion gear, wherein the bracket comprises a pair of ears, and further comprising a stationary shaft that is supported by the pair of ears, wherein the pinion gear rotates about the stationary shaft.

15. The machine according to claim 14, wherein the stationary shaft is keyed to the bracket, wherein the handle comprises a knob and an elongated shaft that has a first end attached to the bracket and an opposite second end attached to the knob.

16. The machine according to claim 15, wherein the spring is disposed on the shaft, wherein the spring axially biases the pinion gear into the first position, and wherein pulling on the handle against the spring moves the pinion gear into the second position.

17. The machine according to claim 13, wherein the handle is pivotable with respect to the second component.

18. The machine according to claim 12, wherein the first component comprises a weight and the second component comprises a weight rack.

* * * * *